US007048060B2

(12) United States Patent
Østergaard

(10) Patent No.: US 7,048,060 B2
(45) Date of Patent: May 23, 2006

(54) SUBSEA SYSTEM FOR PROCESSING FLUID

(75) Inventor: Inge Østergaard, Heggedal (NO)

(73) Assignee: Vetco Aibel AS, Billingstad (NO)

( * ) Notice: Subject to any disclaimer, the term of this patent is extended or adjusted under 35 U.S.C. 154(b) by 203 days.

(21) Appl. No.: 10/743,534

(22) Filed: Dec. 23, 2003

(65) Prior Publication Data

US 2004/0200620 A1 Oct. 14, 2004

(30) Foreign Application Priority Data

Dec. 27, 2002 (NO) ..... 20026260

(51) Int. Cl.
*E21B 43/17* (2006.01)

(52) U.S. Cl. ..... 166/357; 166/339

(58) Field of Classification Search ..... 166/339, 166/341, 344, 351, 357, 366, 368
See application file for complete search history.

(56) References Cited

U.S. PATENT DOCUMENTS 3,536,135 A * 10/1970 Dozier ..... 166/347
4,090,560 A * 5/1978 Hoel et al. ..... 166/344
4,194,857 A * 3/1980 Chateau et al. ..... 405/203
4,438,817 A 3/1984 Pokladnik et al.
4,793,418 A 12/1988 Wheeler et al.
5,025,865 A 6/1991 Caldwell et al.
5,114,117 A * 5/1992 Appleford et al. ..... 251/149.9
6,068,427 A * 5/2000 Østergaard ..... 405/191
6,197,095 B1 3/2001 Ditria et al.
6,481,504 B1 11/2002 Gatherar
6,640,901 B1 * 11/2003 Appleford et al. ..... 166/357
6,832,874 B1 * 12/2004 Appleford et al. ..... 405/189

FOREIGN PATENT DOCUMENTS

GB 1283070 A 7/1972
GB 2261271 A * 5/1993
WO 01/20128 3/2001

* cited by examiner

*Primary Examiner*—David Bagnell
*Assistant Examiner*—Daniel P Stephenson
(74) *Attorney, Agent, or Firm*—Venable LLP; Eric J. Franklin

(57) ABSTRACT

A subsea system for processing a fluid emanating from one or more subsea wells, comprising a fluid processing circuit and a base module (3) provided with at least one receiver (40) for receiving an insert module (4-8) comprising an appliance that forms part of the fluid processing circuit. The receiver (40) comprises a cavity (30) for accommodating the insert module (4-8). The insert module (4-8) is provided with a flange (31), which is adapted to bear on a corresponding flange (32) of the receiver (40) when the insert module (4-8) is mounted therein, a watertight seal (33) being arranged between said flanges (31, 32) so as to seal the space between the receiver (40) and the part of the insert module (4-8) received therein from the surrounding sea water.

26 Claims, 5 Drawing Sheets

SUBSEA SYSTEM FOR PROCESSING FLUID

FIELD OF THE INVENTION AND PRIOR ART

The present invention relates to a subsea system for processing a fluid emanating from one or more subsea wells, and including a fluid processing circuit and a base module provided with at least one receiver for receiving an insert module including an appliance that forms part of the fluid processing circuit.

The invention is particularly advantageously in, though not restricted to, offshore applications at deep and ultra deep water depths including 1000 m or more for remotely operating and processing a multiphase fluid of oil, water and gas, which may further contain solid material, such as sand particles, to be processed and separated out into its phases.

Development within offshore oil and gas exploration in the recent years has been directed to subsea installations for processing and transport of oil and gas. These subsea installations replace the traditional platforms, where oil and gas were transported up to the platform for further processing and transport. A subsea processing system for separation of well fluids and solids is e.g. previously known from U.S. Pat. No. 6,197,095 B1. In this document it is suggested that individual components of the system, such as cyclone separators, gravity separators, coalescers etc., should have a modular construction so as to form interchangeable building blocks. Hereby, it will be possible to easily adapt the system as needed to the prevailing processing conditions. In the subsea processing system disclosed in U.S. Pat. No. 6,197,095 B1, all the modules are arranged to be mounted in a single housing or frame so as to be transported jointly to and from the seabed.

A subsea processing system having a modular construction is also disclosed in WO 01/20128 A1. This system comprises one fluid separation module or two identical fluid separation modules, each module accommodating all the appliances required for performing the desired processing of the fluid in question. The respective module is adapted to be mounted to a foundation structure secured to the seabed by being lowered down vertically into engagement with the foundation structure and demounted from the foundation structure by being lifted vertically out of engagement therewith. By providing two identical fluid separation modules, the subsea processing system is able to continue operating when one of the modules is removed for repair or replacement.

SUMMARY OF THE INVENTION

The object of the present invention is to provide an improved modular subsea system for processing a fluid emanating from one or more subsea wells.

According to the invention, this object is achieved by a subsea system having features described herein. The respective insert module of the subsea system according to the invention is provided with a flange, which is adapted to bear on a corresponding flange of the receiver when the insert module is mounted therein, a watertight seal being arranged between sealing surfaces in or at said flanges so as to seal the space between the receiver and the part of the insert module received therein from the surrounding sea water. Hereby, it will be possible to seal the space between the receiver and the insert module from the surrounding sea water by means of one single seal. Furthermore, by arranging the seal between a flange of the insert module that bears on a corresponding flange of the receiver, it will be possible to achieve a simple and very reliable sealing of said space. By the arrangement of a processing appliance in a separate insert module, it will be possible to easily adapt the system as needed to the prevailing processing conditions. Furthermore, it will be possible to remove an individual processing appliance from the remaining part of the subsea system when the appliance has to be subjected to repair, maintenance or replacement, without the remaining part of the subsea system having to be lifted from the seabed. The present invention also allows that the retrievable processing appliances of the subsea system may be built with a minimum of volume and weight.

According to a preferred embodiment of the invention, the watertight seal provided between the flanges is a metal seal. It is realised that said metal seal should be of corrosion resistant metal material. Hereby, a more reliable barrier to the surrounding sea water is obtained as compared to the use of a conventional elastomer seal. It has been the experience that elastomer seals have shown signs of degeneration in course of time due to ageing, which may result in loss of flexibility, and cause water ingress. This problem is eliminated by the use of a metal seal.

According to a further preferred embodiment of the invention, the insert module and the receiver are designed to allow the corresponding fluid inlets and fluid outlets of the insert module and the receiver to be in fluid communication with each other when the insert module is mounted in the receiver irrespective of the mutual angle of rotation between the insert module and the receiver so as to allow the insert module to be mounted in the receiver in arbitrary angle of rotation in relation to the receiver. Hereby, the orientation of the insert module about its centre axis does not have to be controlled during the mounting of the insert module to the base module. The mounting of the insert module is thereby facilitated. Preferably, an inlet or outlet of the insert module is in fluid communication with the corresponding inlet or outlet of the receiver via a ring-shaped channel when the insert module is mounted in the receiver.

According to a further preferred embodiment of the invention, said ring-shaped channel is formed between a lateral wall of the insert module and a corresponding lateral wall of the receiver, sealing devices being provided to form seals between said lateral walls in order seal the ring-shaped channel from the surroundings when the insert module is mounted in the receiver. Hereby, the pressure forces caused by the fluid in the ring-shaped channel will be balanced.

According to a further preferred embodiment of the invention, the respective sealing device between said lateral walls comprises a radially expandable, ring-shaped sealing member. Hereby, the sealing members may be expanded so as to form said seals after the insertion of the insert module into the receiver cavity. Wearing and frictional forces between the sealing devices and the lateral walls will thereby be prevented during said insertion.

According to a further preferred embodiment of the invention, the respective sealing device comprises a displaceable wedge, preferably in the form of a split-ring, for expanding the associated sealing member radially. Hereby, it will be possible to achieve the expansion of the sealing member in a simple and reliable manner.

According to a further preferred embodiment of the invention, a flow channel is provided in the insert module for allowing sea water to flow from the space between the insert module and the receiver into the surrounding sea during the insertion of the insert module into the receiver and in the opposite direction during the withdrawal of the insert module from the receiver. Hereby, entrapped sea water will be prevented from obstructing the insertion and the withdrawal of the insert module.

According to a further preferred embodiment of the invention, a cut-off valve is provided in said flow channel. Hereby, it will be possible to seal off any leakage caused by a malfunctioning sealing device.

According to a further preferred embodiment of the invention, a male-shaped or female-shaped member is arranged in the bottom of the insert module, said male-shaped or female-shaped member being adapted to fit into a corresponding female-shaped or male-shaped member arranged in the bottom of the receiver cavity when the insert module is mounted in the receiver. Hereby, the hydraulic pressure area at the bottom of the insert module is reduced.

According to a further preferred embodiment of the invention, a guiding member having the shape of a truncated cone is arranged around the upper opening of the receiver cavity, the system comprising a mounting tool intended to carry the insert module during the lowering thereof to the receiver and/or the lifting thereof from the receiver, said mounting tool being provided with a lower part having the shape of a truncated cone that fits into the guiding member of the receiver. Hereby, the mounting and the demounting of the insert module may be performed in a simple and reliable manner.

Further advantages as well as advantageous features of the invention will appear from the following description.

BRIEF DESCRIPTION OF THE DRAWINGS

With reference to the appended drawings, a specific description of preferred embodiments of the invention cited as examples follows below.

In the drawings.

DETAILED DESCRIPTION OF PREFERRED EMBODIMENTS OF THE INVENTION

Figure 1:
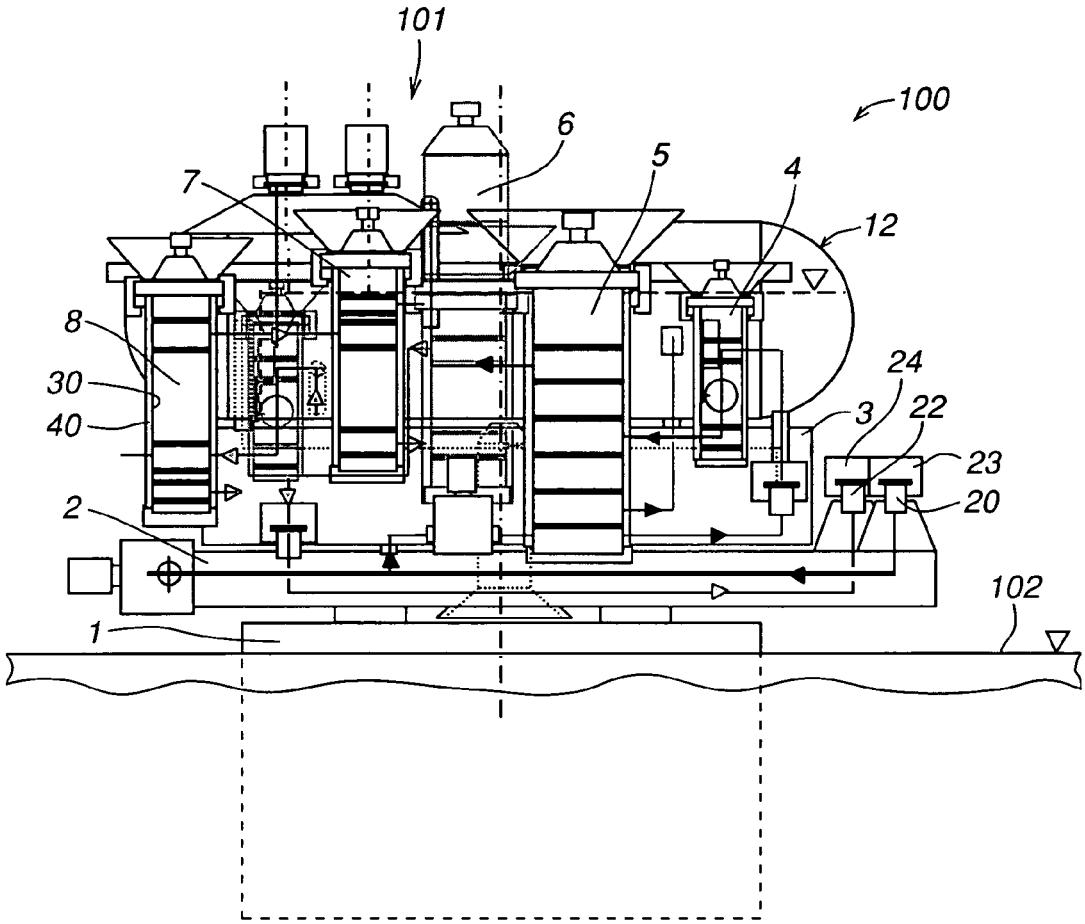
FIG. 1 is a schematical, partly cut sectional view of a subsea system according to an embodiment of the present invention.
Figure 2:
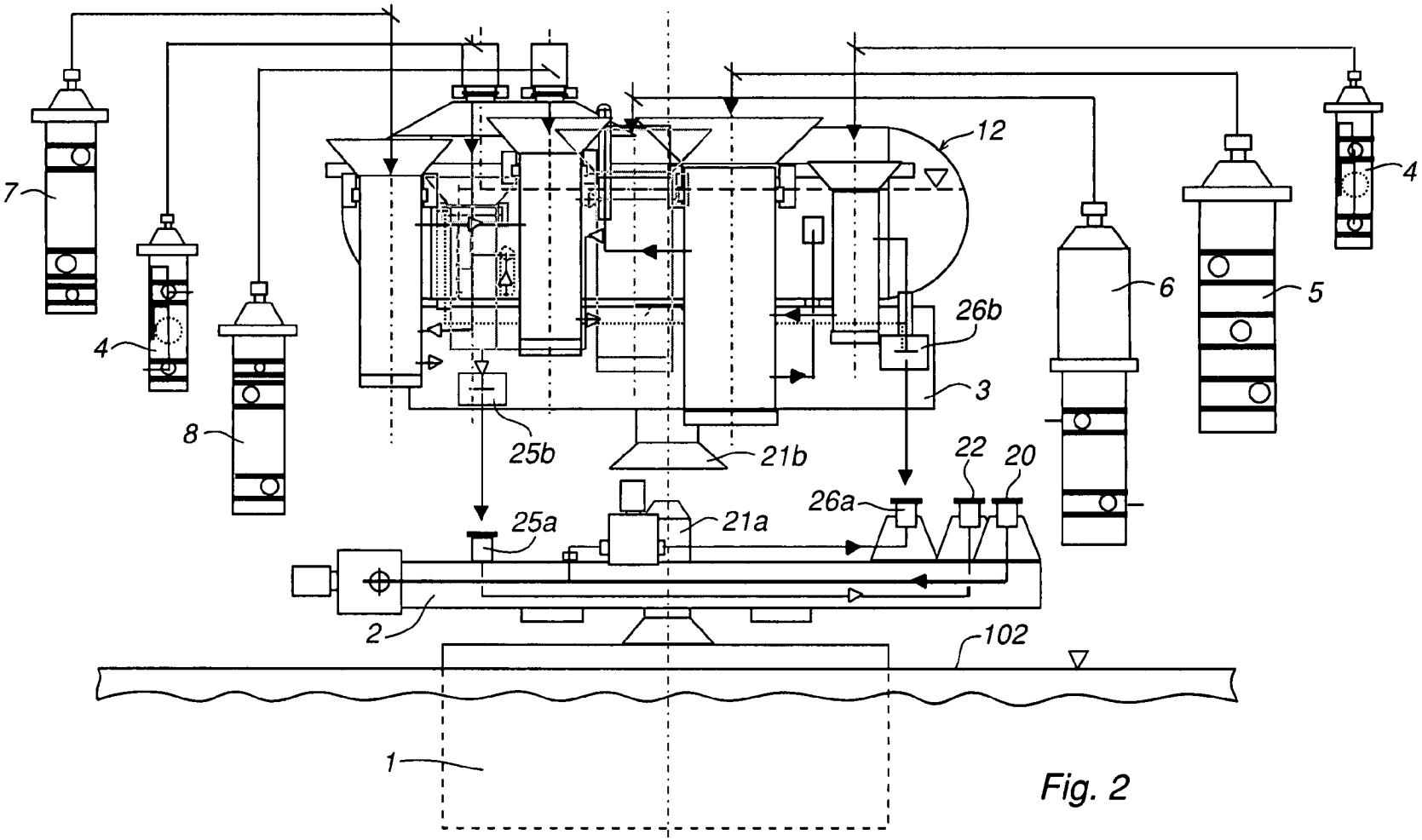
FIG. 2 is a schematical exploded view of the subsea system according to FIG. 1.
Figure 3:
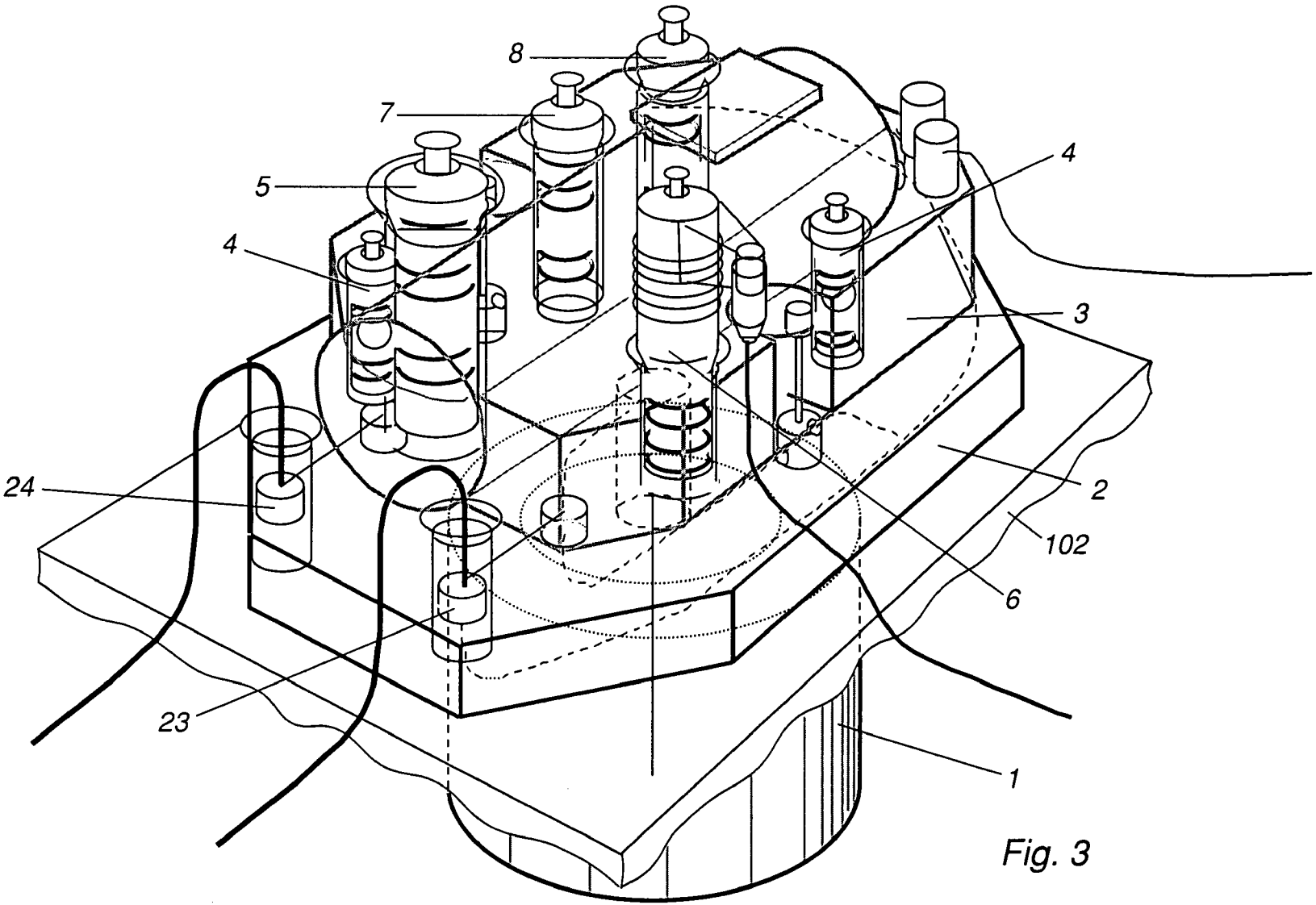
FIG. 3 is a schematical perspective view of the subsea system according to FIG. 1.

FIGS. 1–3 illustrate a subsea system 100 according to an embodiment of the present invention for processing a fluid emanating from one or more subsea wells. The subsea system 100 has a fluid processing circuit 101 built up of separate appliances 4-8, 12 each of which performing a specific function in the desired processing of the fluid. The subsea system 100 comprises a base module 3 provided with at least one receiver 40 for receiving an insert module 4-8, which insert module 4-8 comprises one of the appliances that forms part of the fluid processing circuit. The receiver 40 has a cavity 30 for accommodating the insert module 48 and the insert module 4-8 is adapted to be removably mounted to the base module 3 by being lowered down vertically, or at least substantially vertically, into the cavity 30 of the receiver 40 through an opening at the upper part of the cavity 30 and demounted from the base module 3 by being lifted vertically, or at least substantially vertically, out of the cavity 30, as will be more closely described below. In the illustrated embodiment, the base module 3 is provided with six such receivers 40 and the processing circuit 101 consequently comprises six insert modules 4-8 of the indicated type. The base module 3 comprises a piping system for interconnecting the processing appliances of the different insert modules 4-8.

In the embodiment illustrated in FIGS. 1–3, the base module 3 is removably mounted to a so-called header piping module 2, which in its turn is removably mounted to a foundation structure 1 secured to the seabed 102. The header piping module 2 comprises an inlet 20 for receiving fluid to be processed by the subsea system 100. The piping system of the base module 3 is arranged to be in fluid communication with the inlet 20 of the header piping module 2 when the base module 3 is mounted to the header piping module 2. The header piping module 2 also comprises an outlet 22 for fluid processed by the subsea system 100. The piping system of the base module 3 is arranged to be in fluid communication with the outlet 22 of the header piping module 2 when the base module 3 is mounted to the header piping module 2. In the figures there are only shown one inlet 20 and one outlet 22. However, it should be understood that the header piping module 2 could also comprise a plurality of inlets 20 and outlets 22 respectively.

The outlet 22 of the header piping module 2 is preferably adapted to receive a substantially vertically directed connecting member 24, which is the end-piece of an external fluid conduit, i.e. the flowline for the out-going flow, as illustrated in FIGS. 1 to 3. The connecting member 24 is thus adapted to be lowered down substantially vertically into engagement with the outlet 22. In the same manner, the inlet 20 of the header piping module 2 is preferably adapted to receive a substantially vertically directed connecting member 23, which is the end-piece of an external fluid conduit, i.e. the flowline for the in-going flow, as also illustrated in FIGS. 1 to 3. The connecting member 23 is thus adapted to be lowered down substantially vertically into engagement with the inlet 20.

In the illustrated embodiment (see FIG. 2), the piping system of the header piping module 2 is connected to the piping system of the base module 3 through two pairs of vertically directed connecting members 25*a*, 25*b* and 26*a*, 26*b*. These connecting members 25*a*, 25*b*, 26*a*, 26*b* are adapted to allow the piping systems to be automatically connected to each other when the base module 3 is lowered down into engagement with the header piping module 2. A first pair of connecting members 25*a*, 25*b* is arranged to allow the fluid to flow into the piping system of the base module 3 from the inlet 20 of the header piping module 2 and the other pair of connecting members 26*a*, 26*b* is arranged to allow the fluid to flow from the piping system of the base module 3 to the outlet 22 of the header piping module 2.

The header piping module 2 is supported by the foundation structure 1 when the header piping module 2 is mounted thereto. The header piping module 2 supports the base module 3 when the base module 3 is mounted thereto. The base module 3 supports the respective insert module 4-8 when mounted thereto.

The base module 3 is adapted to be mounted to the header piping module 2 by being lowered down substantially vertically into engagement with the header piping module 2 and demounted from the header piping module 2 by being lifted substantially vertically out of engagement therewith. In the same manner, the header piping module 2 is adapted to be mounted to the foundation structure 1 by being lowered down substantially vertically into engagement with the foundation structure 1 and demounted from the foundation structure 1 by being lifted substantially vertically out of engagement therewith. The lowering and lifting of the base module 3 and the header piping module 2, respectively, is e.g. carried out be means of a winch device arranged on a ship or on a platform and connected to the respective module 2, 3 through a rope, a wire or other means of lifting and lowering.

In the illustrated embodiment (see FIG. 2), the foundation structure 1 is provided with a guiding member 21*a* adapted to engage with a corresponding guiding member, not shown, of the header piping module 2 when the header piping module 2 is lowered down into engagement with the foundation structure 1 so as to secure that the header piping module 2 will be correctly positioned in relation to the foundation structure 1. The base module 3 is provided with a guiding member 21*b* corresponding to the guiding member 21*a* of the foundation structure 1. The guiding member 21*b* of the base module 3 is adapted to engage with the guiding member 21*a* of the foundation structure 1 when the base module 3 is lowered down into engagement with the header piping module 2 so as to secure that the base module 3 will be correctly positioned in relation to the header piping module 2 and the foundation structure 1. The guiding member 21*b* of the base module 3 preferably has its centre axis coinciding with the centre-of-gravity axis of the base module and the guiding member of the header piping module 2 preferably has its centre axis coinciding with the centre-of-gravity axis of the header piping module. In the illustrated embodiment, the guiding member 21*a* of the foundation structure 1 is a male-shaped member in the form of a protrusion extending from the upper surface of the foundation structure. The guiding member of the header piping module 2 and the guiding member 21*b* of the base module 3 is a corresponding female-shaped member. The guiding member 21*b* is here provided with a member having the shape of a truncated cone at its lower part, which is intended to co-operate with a correspondingly shaped upper part of the guiding member 21*a*. The base module 3 could also be provided with a guiding member (female- or male-shaped) adapted to engage with a corresponding guiding member of the header piping module 2. The foundation structure 1 could alternatively be provided with a female-shaped guiding member adapted to engage with a corresponding guiding member of the header piper module 2 and/or the base module 3.

The subsea system 100 of FIGS. 1–3 constitutes a system for separating a multiphase fluid emanating from one or more subsea wells. A first and a second insert module 4 comprises a remotely operated ball valve, a third insert module 5 comprises a cyclonic separator operable for removing a gas phase from the multiphase fluid, a fourth insert module 6 comprises a water injection pump, a fifth insert module 7 comprises a cyclonic separator operable for removing solids from the multiphase fluid and a sixth insert module 8 comprises a cyclonic de-oiling separator. In the illustrated embodiment, the base module 3 is also provided with a separator vessel 12 for gravitational separation of the multiphase fluid, said separator vessel 12 being rigidly secured to the base module 3. Preferably, the base module 3 is also provided with a coalescing device, not shown, said coalescing device preferably being adapted to be removably mounted to the base module. The subsea system of the present invention could of course also have other designs than here illustrated and be provided with other types of processing appliances.

In FIG. 2, the subsea system is illustrated in an exploded view, with the different modules 2, 3, 4-8 separated from each other while FIG. 3 is schematic three-dimensional view showing a layout of said modules as mounted in the in the header piper module 2.

Figure 4:
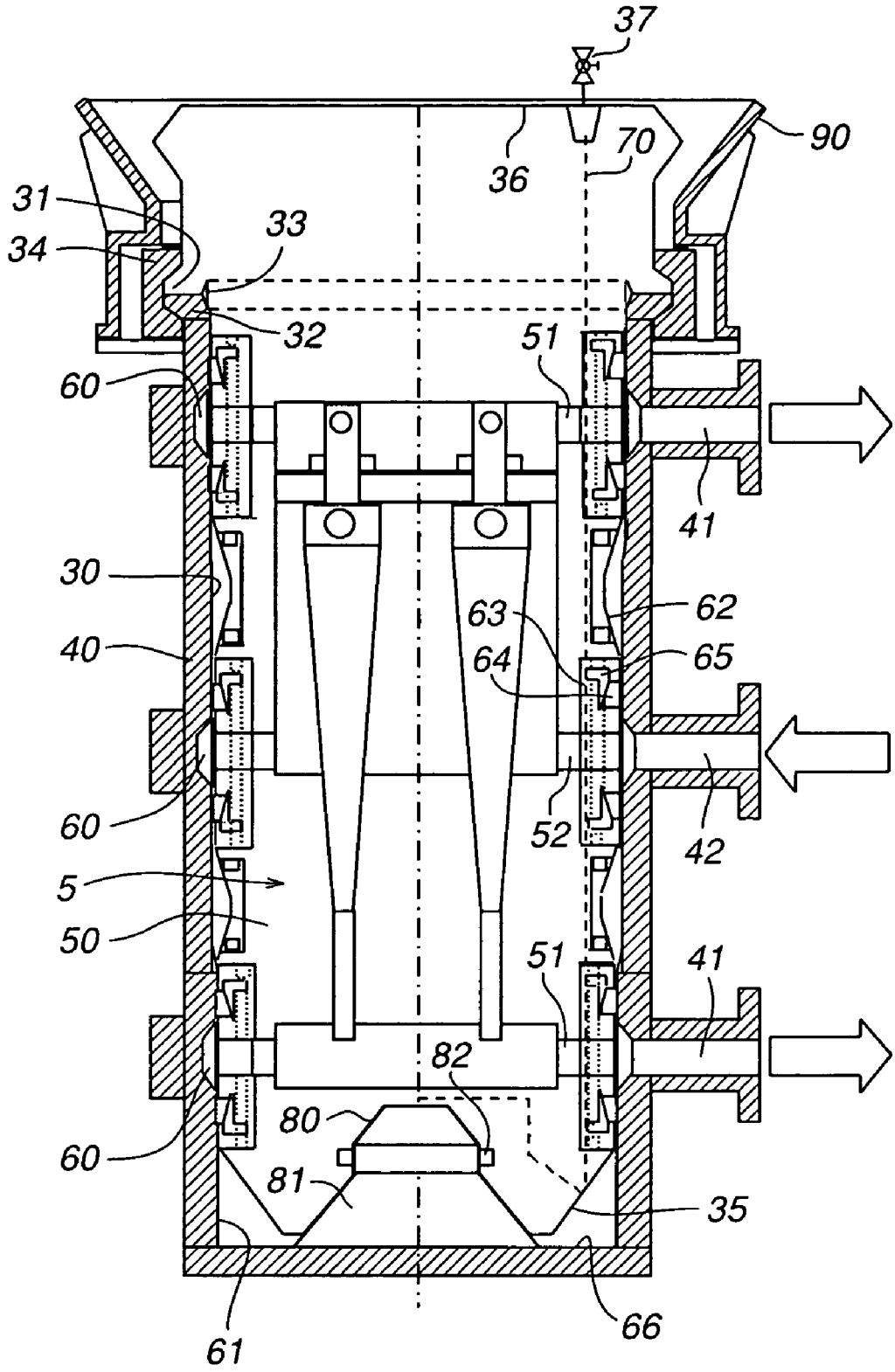
FIG. 4 is a schematical cross-sectional view of an insert module and its corresponding receiver included in a subsea system according to the present invention.

An insert module 5 in the form of a de-gasser and its corresponding receiver 40 included in a subsea system according to the present invention are illustrated in closer detail FIG. 4. The degasser includes cyclonic separators for the separation of the gas phase from a multiphase fluid comprising oil, water and gas. The receiver 40 is here provided with one fluid inlet 42 for the multiphase fluid to be separated, and two fluid outlets 41 for the separated gas phase, and is adapted to be in fluid communication with a corresponding fluid inlet 52 and fluid outlets 51, respectively, of the insert module 5 when the insert module is mounted in the cavity 30 of the receiver 40. The insert module 5 is provided with a flange 31 at its upper end, which flange 31 is adapted to bear on a corresponding flange 32 of the receiver 40 when the insert module 5 is mounted therein. The flange 32 of the receiver 40 is arranged to surround the opening at the upper part of the cavity 30. A watertight seal 33, preferably in the form of a metal seal, is arranged between said flanges 31, 32 so as to seal the space between the receiver 40 and the part of the insert module 5 received therein from the surrounding sea water.

The fluid inlet 52 of the respective insert module 4-8 extends horizontally, or at least essentially horizontally, when the insert module 4-8 is mounted in its receiver 40 so as to allow the fluid to enter the insert module 4-8 in a horizontally directed, or at least essentially horizontally directed flow. Each fluid outlet 51 of the respective insert module 4-8 also extends horizontally, or at least essentially horizontally, when the insert module 4-8 is mounted in its receiver so as to allow the fluid to leave the insert module 4-8 in a horizontally directed, or at least essentially horizontally directed flow. Consequently, the respective inlet 52 and outlet 51 is arranged with its orifice in a lateral wall 62 of the insert module 4-8. In the same manner, the respective fluid outlet 41 and fluid inlet 42 of the receiver 40 extends horizontally, or at least essentially horizontally, so as to allow the fluid to enter and leave the receiver 40 in a horizontally directed, or at least essentially horizontally directed flow. Consequently, the respective outlet 41 and inlet 42 of the receiver is arranged with its orifice in a vertically extending lateral wall 61 of the receiver 40. The fluid conduits of the respective inlet 42 and outlet 41 is thus radially placed and connected in relation to the receiver 40 at different levels. Preferably, the bottom surfaces 35, 66 of the respective insert module 4-8 and its receiver 40 lack fluid inlets and fluid outlets.

A locking device, schematically indicated at 34 in FIG. 4, is suitably arranged in the receiver 40 or in the insert module 5 so as to secure the insert module 5 to the receiver 40 after the positioning of the insert module 5 with its flange 31 abutting against the corresponding flange 32 of the receiver. The locking device 34 is arranged to clamp the flanges 31, 32 tightly to each other.

The respective insert module 4-8 is suitably rotational symmetric, the corresponding receiver cavity 30 having a corresponding rotational symmetric shape. In the illustrated embodiment, the respective insert module 4-8 comprises an essentially circular cylindrical body 50 designed to fit with a certain tolerance in a receiver cavity 30 having a corresponding circular cylindrical shape.

The respective insert module 4-8 and its receiver 40 are preferably designed to allow the corresponding fluid outlets and fluid inlets 41, 51 and 42, 52 of the receiver 40 and the insert module 4-8 to be in fluid communication with each other when the insert module 4-8 is mounted in the receiver 40 irrespective of the mutual angle of rotation between the insert module 4-8 and the receiver 40 so as to allow the insert module 4-8 to be mounted in the receiver 40 in arbitrary angle of rotation in relation to the receiver. In the embodiment illustrated in FIG. 4, the outlets 51 and inlet 52 of the insert module 5 are in fluid communication with the corresponding outlets 41 and inlet 42 of the receiver 40 via a ring-shaped channel 60 when the insert module is mounted in the receiver. The centre axis of the ring-shaped channel 60 coincides with the centre axis of the insert module 5 when the insert module is mounted in the receiver 40. The ring-shaped channel 60 is here formed by a ring-shaped recess in a wall 61 of the receiver 40. It is of course also possible to provide the ring-shaped recess in a wall of the insert module 5 so as to form the desired ring-shaped channel. Another alternative would be to have the ring-shaped recess formed jointly by a ring-shaped recess in the wall of the insert module 5 and a corresponding ring-shaped recess in the wall of the receiver 40.

Said ring-shaped channel 60 is preferably formed between a lateral wall 62 of the insert module 5 and a corresponding lateral wall 61 of the receiver 40, as illustrated in FIG. 4, Sealing devices 63 are here provided to form seals between said lateral walls 61, 62 in order seal the ring-shaped channel 60 from the surroundings when the insert module is mounted in the receiver 40. A first ring-shaped sealing device 63 is arranged above the respective channel 60 and a second ring-shaped sealing device 63 is arranged below the channel 60. The respective sealing device 63 preferably comprises a radially expandable, ring-shaped sealing member 64. In the illustrated embodiment, a displaceable wedge 65, preferably in the form of a split-ring, is provided for expanding the associated sealing member 64 radially. The wedge 65 is preferably hydraulically operated. The sealing devices 63 are preferably mounted in the insert module 5, as illustrated in FIG. 4, but they may instead be mounted in the receiver 40 if so desired.

A flow channel 70 is suitably provided in the insert module 4-8, as illustrated in FIG. 4, so as to allow sea water to flow from the space between the insert module 4-8 and the receiver 40 into the surrounding sea during the insertion of the insert module 4-8 into the receiver 40 and in the opposite direction during the withdrawal of the insert module 4-8 from the receiver 40. The flow channel 70 preferably extends between the bottom 35 of the insert module and the top 36 thereof. A cut-off valve 37 is preferably provided in the flow channel 70, as indicated in FIG. 4, so as to make it possible to seal off any leakage caused by a malfunctioning sealing device 63.

In the embodiment illustrated in FIG. 4, a female-shaped member 80 in the form of a rotational symmetric recess is arranged in the bottom of the insert module 5. Said female-shaped member 80 is adapted to fit into a corresponding male-shaped member 81 in the form of a rotational symmetric protrusion arranged in the bottom 66 of the receiver cavity 30 when the insert module 5 is mounted in the receiver 40. The members 80, 81 have their centre axis coinciding with the centre axis of the insert module 5 and the receiver cavity 30, respectively. A sealing member 82 is arranged between the member 80 of the insert module 5 and the corresponding member 81 of the receiver cavity 30. If so desired, a female-shaped member could instead be arranged in the bottom 66 of the receiver cavity 30 and a corresponding male-shaped member in the bottom of the insert module 5.

Figure 5:
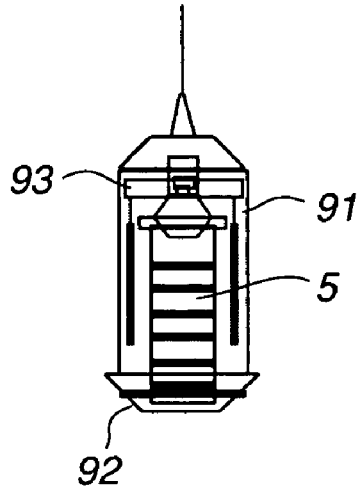
FIG. 5 is a schematical cross-sectional view of a mounting tool intended to carry the insert module during the lowering thereof to the base module and the lifting thereof from the base module.

The receiver 40 is preferably provided with a guiding member 90 arranged around the upper opening of the receiver cavity 30, which guiding member 90 has the shape of a truncated cone. This guiding member 90 is intended to co-operate with a corresponding guiding member 92 provided in a mounting tool 91, see FIGS. 5 and 6. Said mounting tool 91 is designed for carrying an insert module 4-8 during the lowering thereof to a receiver 40 in connection with the mounting of an insert module into the receiver. The mounting tool 91 is also designed for carrying an insert module 4-8 during the demounting thereof from the receiver. Consequently, the mounting tool 91 is intended to carry the insert module 4-8 between e.g. a ship or a platform and the base module 3. The guiding member 92 of the mounting tool 91 is preferably formed by the lower part 92 of the mounting tool, which part 92 has the shape of a truncated cone that fits into the guiding member 90 of the receiver 40. It is evident that the guiding members 90, 91 are to widen upwards, so as to make possible a guiding of the insert module 4-8 into the correct position in relation to the receiver 40 in connection with the mounting of the insert module. The mounting tool 91 is provided with a hoisting device 93 for lowering an insert module 4-8 out of the mounting tool 91 and down into the receiver cavity 30 after the correct positioning of the mounting tool 91 in relation to the receiver 40. By means of the hoisting device, it is also possible to lift an insert module 4-8 out of the receiver cavity 30 and up into the mounting tool 91. The lowering and lifting of the mounting tool 91 is e.g. carried out be means of a winch device arranged on a ship or on a platform and connected to the mounting tool through a rope, a wire, or other means of lifting and lowering, while the insert module 4-8 itself is lowered and lifted into and out of the receiver without the use of any such ropes, wires or the like.

Figure 6:
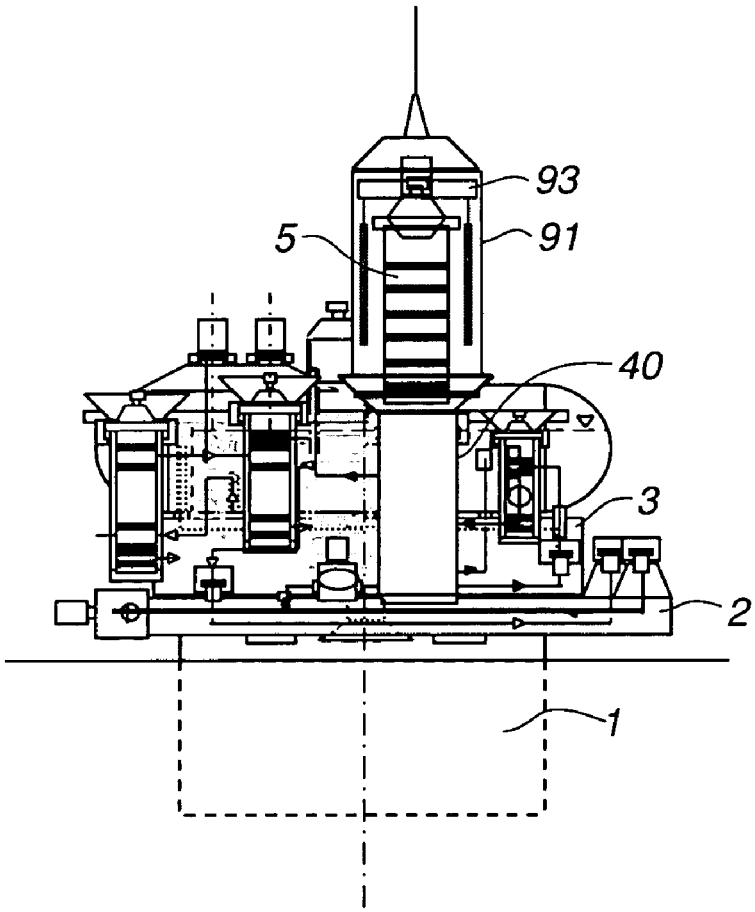
FIG. 6 is a schematical, partly cut sectional view of the subsea system of FIG. 1, showing a mounting tool placed in the position for lowering an insert module down into a receiver.

FIG. 6 shows a mounting tool 91 placed in the position for lowering an insert module 5 down into a receiver 40. The mounting tool 91 is positioned above the receiver 40 with the lower part 92 of the mounting tool 91 abutting on the guiding member 90 of the receiver 40.

If so desired, the insert module could be arranged to be lowered down to the intended receiver without the use of a mounting tool of the above-indicated type. In this case, the lowering and lifting of the insert module could e.g. carried out by means of a winch device arranged on a ship or on a platform and connected to the insert module through a rope or wire.

The invention is of course not in any way restricted to the preferred embodiments described above. On the contrary, many possibilities to modifications thereof will be apparent to a person with ordinary skill in the art without departing from the basic idea of the invention such as defined in the appended claims.

The invention claimed is:

1. A subsea system for processing a fluid emanating from one or more subsea wells, comprising a fluid processing circuit and a base module provided with at least one receiver for receiving an insert module comprising an appliance that forms part of the fluid processing circuit, the receiver comprising a cavity for accommodating the insert module, the insert module being adapted to be mounted to the base module by being lowered down substantially vertically into the cavity of the receiver through an opening at the upper part of the cavity and demounted from the base module by being lifted substantially vertically out of the cavity, the receiver being provided with at least one fluid outlet and at least one fluid inlet adapted to be in fluid communication with a corresponding fluid inlet and fluid outlet, respectively, of the insert module when the insert module is mounted in the cavity of the receiver, wherein the insert module is provided with a flange, which is adapted to bear on a corresponding flange of the receiver when the insert module is mounted therein, a watertight seal being arranged between said flanges so as to seal the space between the receiver and the part of the insert module received therein from the surrounding sea water, wherein the insert module and the receiver are designed to allow the corresponding fluid inlets and fluid outlets of the insert module and the receiver to be in fluid communication with each other when the insert module is mounted in the receiver irrespective of the mutual angle of rotation between the insert module and the receiver so as to allow the insert module to be mounted in the receiver in arbitrary angle of rotation in relation to the receiver.

2. The subsea system according to claim 1, wherein the watertight seal is a metal seal.

3. The subsea system according to claim 1, wherein the flange of the receiver is arranged to surround the opening at the upper part of the receiver.

4. The subsea system according to claim 1, wherein the flange of the insert module is arranged at the upper end thereof.

5. The subsea system according to claim 1, wherein an inlet or outlet of the insert module is in fluid communication with the corresponding inlet or outlet of the receiver via a ring-shaped channel when the insert module is mounted in the receiver.

6. The subsea system according to claim 5, wherein the center axis of the ring-shaped channel coincides with the center axis of the insert module when the insert module is mounted in the receiver.

7. The subsea system according to claim 5, wherein a wall of the receiver and/or a wall of the insert module is provided with a ring-shaped recess so as to form said ring-shaped channel.

8. The subsea system according to claim 5, wherein the ring-shaped channel is formed between a lateral wall of the insert module and a corresponding lateral wall of the receiver, sealing devices being provided to form seals between said lateral walls in order seal the ring-shaped channel from the surroundings when the insert module is mounted in the receiver.

9. The subsea system according to claim 8, wherein the respective sealing device comprises a radially expandable, ring-shaped sealing member.

10. A subsea system according to claim 9, wherein the respective sealing device comprises a displaceable wedge, preferably in the form of a split-ring, for expanding the associated sealing member radially.

11. The subsea system according to claim 10, wherein the wedge is hydraulically operated.

12. The subsea system according to claim 8, wherein the sealing devices are arranged in the insert module.

13. The subsea system according to claim 1, wherein the insert module is rotational symmetric, the receiver cavity having a corresponding shape.

14. The subsea system according to claim 1, wherein a flow channel is provided in the insert module for allowing sea water to flow from the space between the insert module and the receiver into the surrounding sea during the insertion of the insert module into the receiver and in the opposite direction during the withdrawal of the insert module from the receiver.

15. The subsea system according to claim 14, wherein a cut-off valve is provided in the flow channel.

16. The subsea system according to claim 1, wherein a male-shaped or female-shaped member is arranged in the bottom of the insert module, said male-shaped or female-shaped member being adapted to fit into a corresponding female-shaped or male-shaped member arranged in the bottom of the receiver cavity when the insert module is mounted in the receiver.

17. The subsea system according to claim 16, wherein a sealing member is arranged between the male-shaped or female-shaped member of the insert module and the corresponding member of the receiver cavity.

18. The subsea system according to claim 1, wherein a guiding member having the shape of a truncated cone is arranged around the upper opening of the receiver cavity, and that the system comprises a mounting tool intended to carry the insert module during the lowering thereof to the receiver and/or the lifting thereof from the receiver, said mounting tool being provided with a lower part having the shape of a truncated cone that fits into the guiding member of the receiver.

19. The subsea system according to claim 18, wherein the mounting tool is provided with a hoisting device for lowering an insert module out of the mounting tool and down into the receiver cavity and/or lifting an insert module out of the receiver cavity and up into the mounting tool.

20. The subsea system according to claim 1, wherein the system is provided with an insert module comprising cyclonic devices for fluid separation.

21. The subsea system according to claim 1, wherein the system is provided with an insert module comprising a water pump.

22. The subsea system according to claim 1, wherein the system is provided with an insert module comprising a ball valve.

23. A subsea system for processing a fluid emanating from one or more subsea wells, comprising a fluid processing circuit and a base module provided with at least one receiver for receiving an insert module comprising an appliance that forms part of the fluid processing circuit, the receiver comprising a cavity for accommodating the insert module, the insert module being adapted to be mounted to the base module by being lowered down substantially vertically into the cavity of the receiver through an opening at the upper part of the cavity and demounted from the base module by being lifted substantially vertically out of the cavity, the receiver being provided with at least one fluid outlet and at least one fluid inlet adapted to be in fluid communication with a corresponding fluid inlet and fluid outlet, respectively, of the insert module when the insert module is mounted in the cavity of the receiver, wherein the insert module is provided with a flange, which is adapted to bear on a corresponding flange of the receiver when the insert module is mounted therein, a watertight seal being arranged between said flanges so as to seal the space between the receiver and the part of the insert module received therein from the surrounding sea water, wherein a flow channel is provided in the insert module for allowing sea water to flow from the space between the insert module and the receiver into the surrounding sea during the insertion of the insert module into the receiver and in the opposite direction during the withdrawal of the insert module from the receiver.

24. The subsea system according to claim 23, wherein a cut-off valve is provided in the flow channel.

25. A subsea system for processing a fluid emanating from one or more subsea wells, comprising a fluid processing circuit and a base module provided with at least one receiver for receiving an insert module comprising an appliance that forms part of the fluid processing circuit, the receiver comprising a cavity for accommodating the insert module, the insert module being adapted to be mounted to the base module by being lowered down substantially vertically into the cavity of the receiver through an opening at the upper part of the cavity and demounted from the base module by being lifted substantially vertically out of the cavity, the receiver being provided with at least one fluid outlet and at least one fluid inlet adapted to be in fluid communication with a corresponding fluid inlet and fluid outlet, respectively, of the insert module when the insert module is mounted in the cavity of the receiver, wherein the insert module is provided with a flange, which is adapted to bear on a corresponding flange of the receiver when the insert module is mounted therein, a watertight seal being arranged between said flanges so as to seal the space between the receiver and the part of the insert module received therein from the surrounding sea water, wherein a guiding member having the shape of a truncated cone is arranged around the upper opening of the receiver cavity, and that the system comprises a mounting tool intended to carry the insert module during the lowering thereof to the receiver and/or the lifting thereof from the receiver, said mounting tool being provided with a lower part having the shape of a truncated cone that fits into the guiding member of the receiver.

26. The subsea system according to claim 25, wherein the mounting tool is provided with a hoisting device for lowering an insert module out of the mounting tool and down into the receiver cavity and/or lifting an insert module out of the receiver cavity and up into the mounting tool.

* * * * *